US006219861B1

(12) United States Patent
Chen

(10) Patent No.: US 6,219,861 B1
(45) Date of Patent: Apr. 24, 2001

(54) DRAIN STRUCTURE FOR A SINK

(76) Inventor: Chin-Yuan Chen, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/545,179

(22) Filed: Apr. 7, 2000

(51) Int. Cl.[7] ..... A47K 1/14

(52) U.S. Cl. ..... 4/689; 4/295; 4/693; 251/323; 251/336; 251/339

(58) Field of Search ..... 4/689, 693, 688, 4/287, 288, 295; 251/321–323, 295, 336, 339, 230

(56) References Cited

U.S. PATENT DOCUMENTS 3,220,695 * 11/1965 Downey ..... 4/689 X
4,006,498 * 2/1977 Cuschera ..... 4/693
4,103,372 * 8/1978 Cuschera ..... 4/287 X
4,420,844 * 12/1983 Puckett et al. ..... 4/295
4,764,993 * 8/1988 Oropallo ..... 4/689
5,881,397 * 3/1999 Hobbs ..... 4/287

* cited by examiner

*Primary Examiner*—Gregory L. Huson
*Assistant Examiner*—Kathleen J. Prunner

(57) ABSTRACT

The drain structure includes a valve seat axially secured into a tube drain of a sink or basin, a sleeve disposed in the valve seat and a slider slidably engaged in the sleeve to discharge water from the sink. A double V-shaped slot in a lateral side of the slider is slidably engaged by a transverse end of a U-shaped positioning rod which controls the sliding span of the slider. When a button on the top of the slider is pressed a first time, the valve seat prevents discharge of water. When the button is pressed a second time, the valve seat is moved to discharge the water from the sink.

2 Claims, 8 Drawing Sheets

DRAIN STRUCTURE FOR A SINK

BACKGROUND OF THE INVENTION

The present invention relates to sinks and more particularly to an improved drain structure for a sink or basin which includes a valve in the tube drain to control discharging the water from the sink.

Typical sinks or basins 10 comprise a drain port 11 connected to a drain pipe 12 and a chain 13 connected with a stronger 14 which is used to block up the drain port 11 to receive the water and is extracted out of the drain port 11 to discharge the water from the sink 10. Another type of sink has a lift lever rod on top of the sink to control the operation of a pop-up stopper. This life rod is usually arranged together with the spout system and is structurally complicated and unpleasant to look at, especially for a high class sink.

SUMMARY OF THE PRESENT INVENTION

The present invention has a main object to provide an improved drain structure for a sink which is simple and ready to operate.

Another object of the present invention is to provide an improved drain structure for a sink which is pleasant to look at and especially suits to a high class metal sink.

Accordingly, the improved drain structure of the present invention comprises generally a valve secured into a drain port of a sink and a sliding stopper disposed in the valve and operated by finger press. It is supposed that when a first press is applied on the stopper, it will slide downward to discharge the water from the sink. If a second press is applied on the stopper, it will jump upward to stop the discharging of the water.

The present invention will become more fully understood by reference to the following detailed description thereof when read in conjunction with the attached drawings.

DETAILED DESCRIPTION OF THE PREFERRED EMBODIMENT

Figure 1:
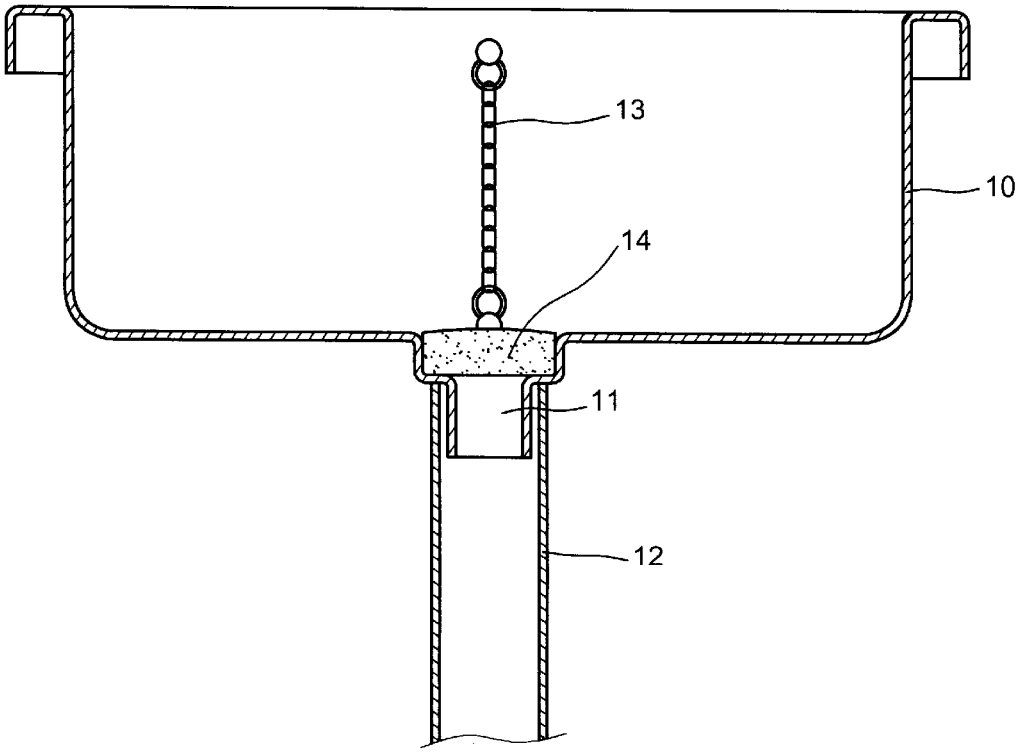
FIG. 1 Prior Art
FIG. 1 is a sectional view of a water sink according to the prior art.
Figure 2:
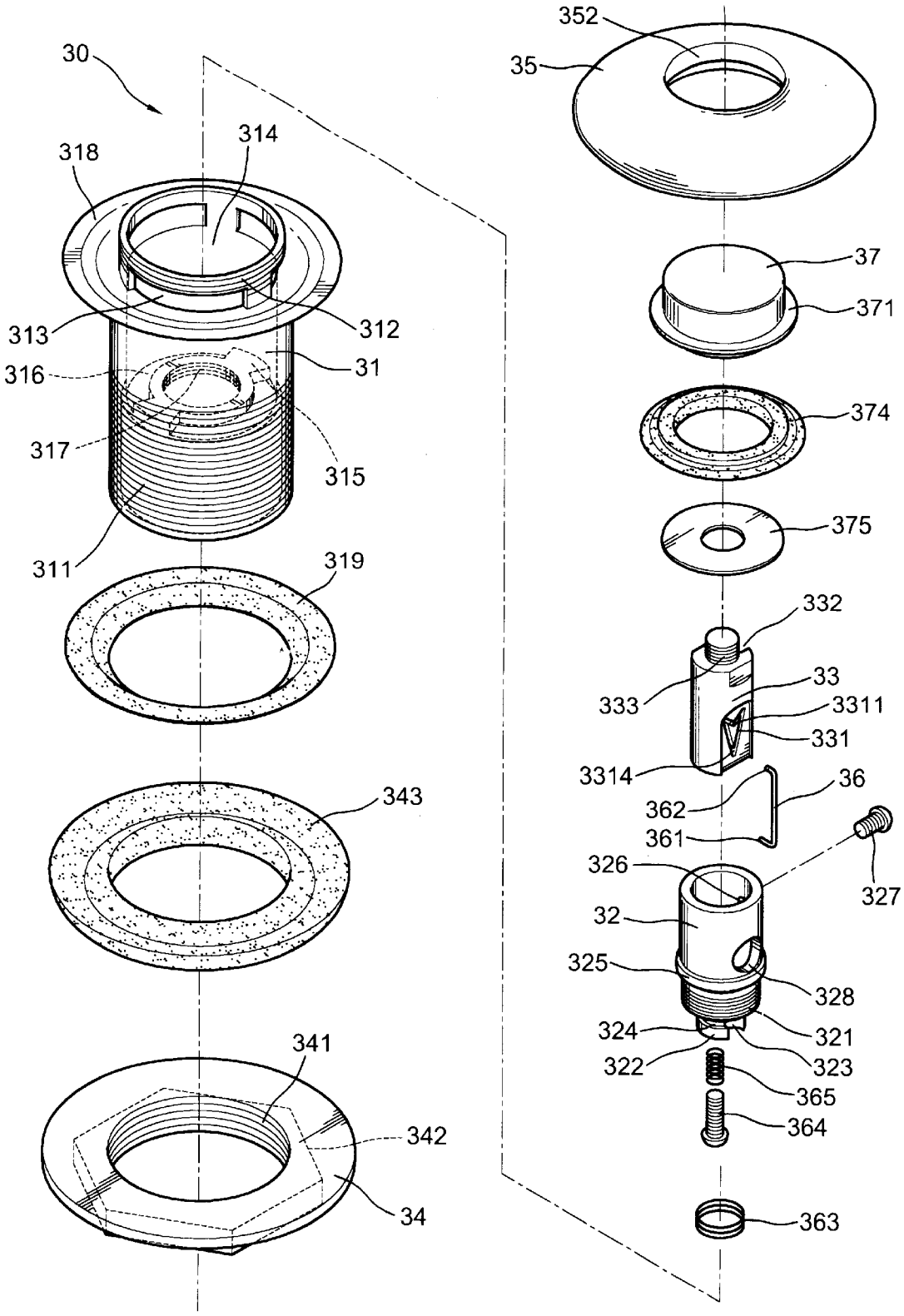
FIG. 2 is an exploded perspective view to show the drain structure of the preferred embodiment according to the present invention.
Figure 3:
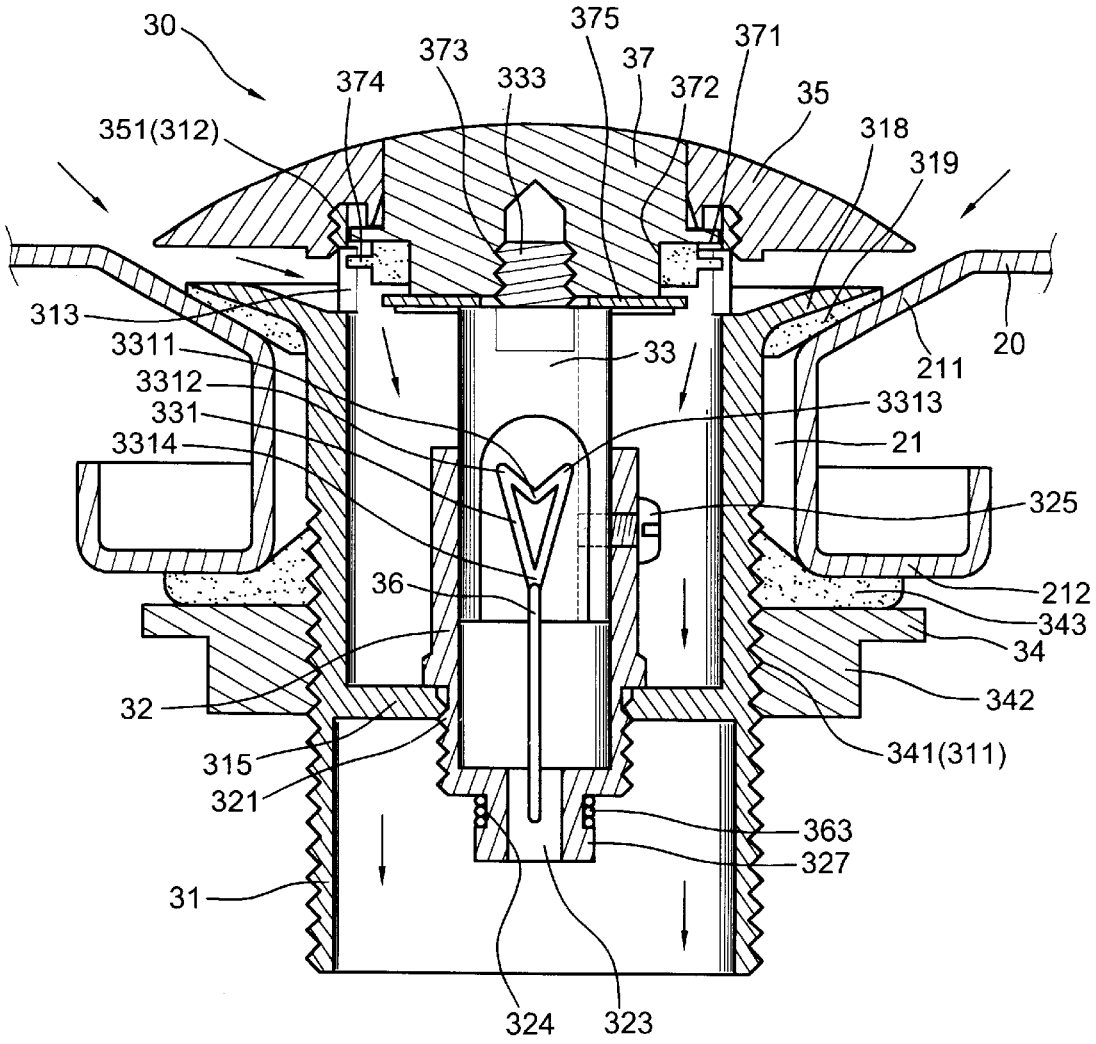
FIG. 3 is a sectional view to show an assembly of FIG. 2.
Figure 8:
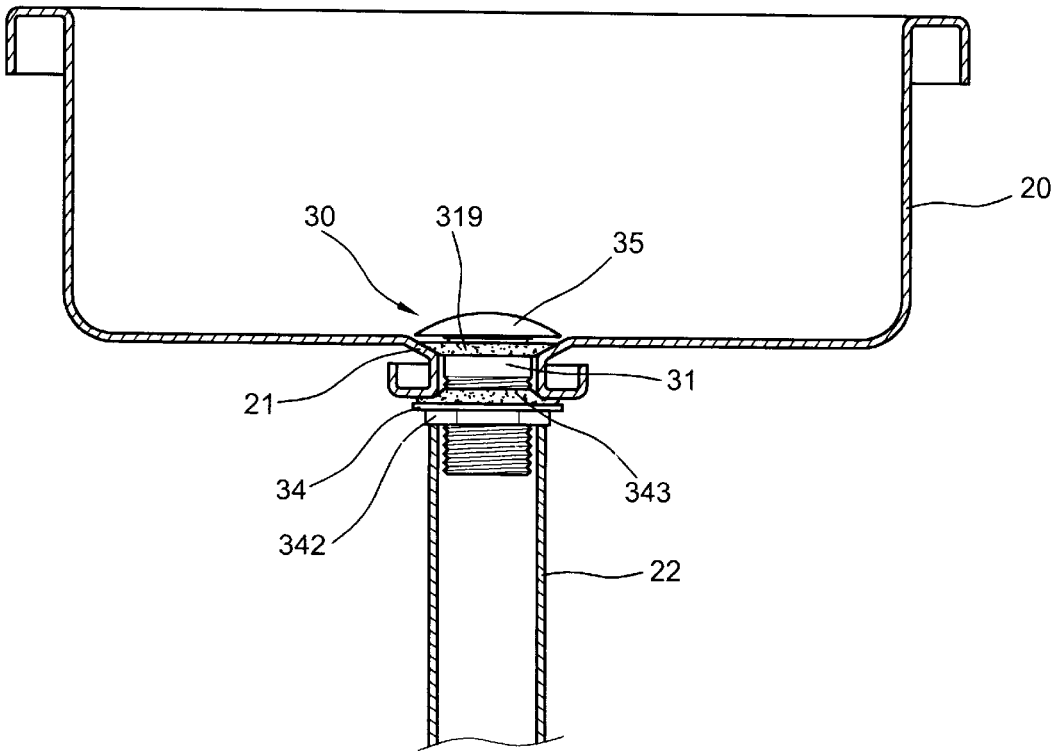
FIG. 8 is a sectional view to show the valve is secured into the drain port of a sink.

With reference to FIGS. 2, 3 and 8 of the drawings, the drain structure of the present invention comprises generally a drain structure 30 axially secured to a tube drain 21 of a sink or basin 20.

Figure 4:
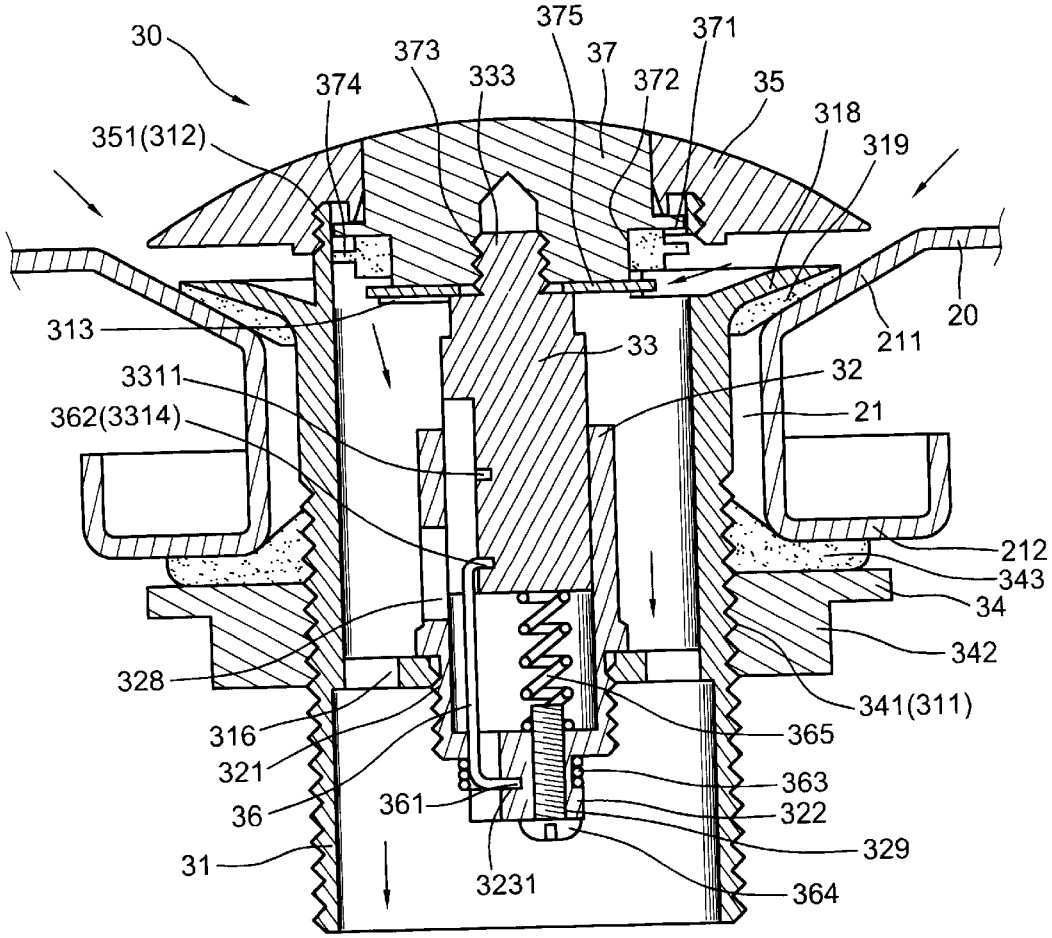
FIG. 4 is a sectional view of FIG. 2 from a lateral side of the valve.

The drain structure 30 includes a tubular valve seat 31, a first circular fastener 34, a tubular sleeve 32, a slider 33, a U-shaped positioning rod 36, a circular button 37 and a second circular fastener 35. The tubular valve seat 31 has a first threaded outer periphery 311 insertable into a drain pipe 22, a second threaded outer periphery 212 on a narrowed protrudent opening 314 on the top thereof, a plurality of spaced water inlets 313 formed in the periphery of the opening 314 beneath the second threaded outer periphery 312, a first annular flange 318 extending outward from the periphery thereof beneath the water inlets 313 and a shoulder 315 formed at a center of the tubular valve seat 31 to define a pair of arcuate water passages 316. The shoulder 315 includes a first threaded central bore 317. The first circular fastener 34 has a second threaded central bore 341 engageable with the first threaded outer periphery 311 of the tubular valve seat 31 and a hexagon configuration 342 on its underside for fastening the fastener on the valve seat 31. The tubular sleeve 32 has a third threaded outer periphery 321 engaged with the first threaded center bore 317 of the valve seat 31 and a narrowed projection 322 extending downward from the bottom which has a lateral indentation 323 communicating to the inside of the sleeve 32. The projection 322 includes a transverse retaining hole 3231 in an inner wall thereof, an annular depression 324 in an outer periphery beneath the third threaded outer periphery 321 and a longitudinal screw hole 329 (as shown in FIG. 4). A second annular flange 325 extends outwardly from an outer periphery of the sleeve 32 above the third threaded outer periphery 321 and a transverse screw hole 326 extends through an upper periphery. A screw 327 engages in the transverse screw hole 326. A circular through hole 328 extends through the sleeve 32 in a position above the second annular flange 325. The U-shaped positioning rod 36 is disposed in the sleeve 32 and has a first transverse end 361 engaging the transverse retaining hole 3231 of the indentation 323 and a second transverse end 362 on the top. The transverse end 361 is secured in position by a band 363 which may be any other packing means. A screw 364 engages the longitudinal screw hole 329 with a part of its shank projected upward inside the sleeve 32 for securing the lower end of a spring 365 thereon. The slider 33 is slidably disposed in the sleeve 32 and is biased by the spring 365. The slider has a double V-shaped slot 331 in a lateral side. The second transverse end 362 of the U-shaped positioning rod 36 engages the slot 331. A longitudinal slot 332 extends along a lateral side of the slider 33 at a position perpendicular to the position of the double V-shaped slot 331 and is slidably engaged with the shank of the screw 327 inside the sleeve 32 to prevent any lateral rotation of the slider 33.

A threaded cylindrical protrusion 333 projects centrally upward from the top of the slider 33. The circular button 37 axially engages the top of the slider 33 with a first sealing ring 374 and a washer 375 disposed therebetween. The button 37 has a third annular flange 371 extending outwardly from an outer periphery, a circular projection 372 projecting centrally downward from the underside thereof beneath the flange 371. A third threaded central bore 373 is disposed in the bottom of the button 37 and is engaged with the threaded cylindrical protrusion 333 of the slider 33. A second circular fastener 35 has a third threaded inner periphery 351 engageable with the second threaded outer periphery 312 of the valve seat 31 and a central hole 352 engageable with the button 37.

To install the device, first sealing ring 319 is sleeved on the valve seat 31 from the underside thereof and the valve seat 31 is disposed axially into the tube drain 21 of the sink 20 with the first annular flange 318 stopped against the upper rim of the tube drain 21 and with the second sealing ring 319 engaged therebetween. The third sealing ring 343 is then sleeved on the valve seat 31 from the underside of the tube drain and then the first circular fastener 34 is tightened on the valve seat 31 by means of a wrench until the third sealing ring 343 completely closes the underside of the tube drain 21. Finally, the second circular fastener 35 is fastened onto the protrudent opening 314 of the valve seat 31. The button 37 is engaged in the central hole 352 of the fastener 35 and stopped by its own flange 371 against the underside of the fastener 35 such that a gap is defined between the second circular fastener and the first annular flange 318 of the valve seat 31 (as shown in FIGS. 3 and 4).

Referring to FIGS. 3 and 4 again, when the button 37 remains in the central hole 352 of the second annular fastener 35, the slider 33 is positioned at an uppermost position because of the resilience of the spring 365 and the second transverse end 362 of the U-shaped positioning rod 36 is engaged with a lower stopping position 3314 of the double V-shaped slot 331. So water inside the sink 20 is permitted to be discharged through the inlets 313 and the outlets 316 of the valve seat 31.

Figure 5:
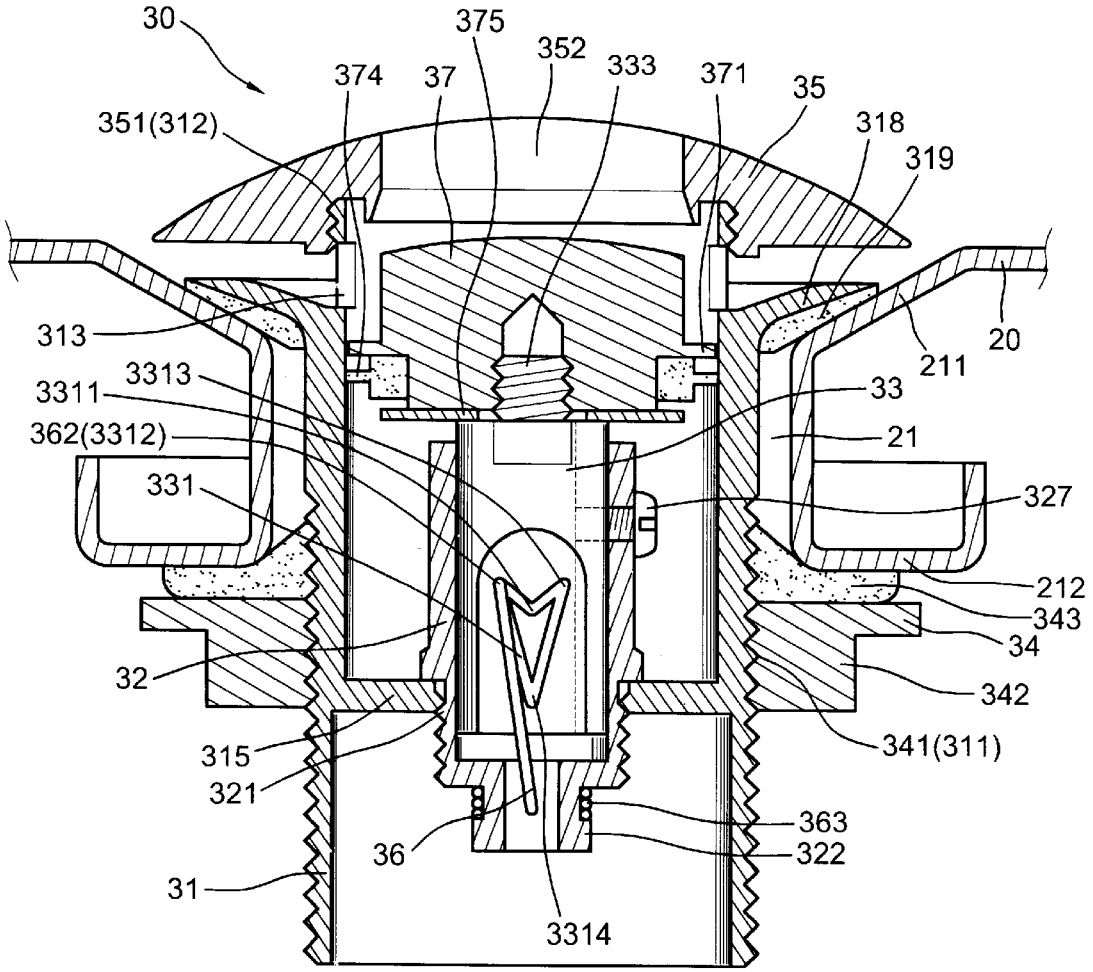
FIG. 5 is a sectional view of FIG. 3 while the stopper is pressed to slide downward.
Figure 6:
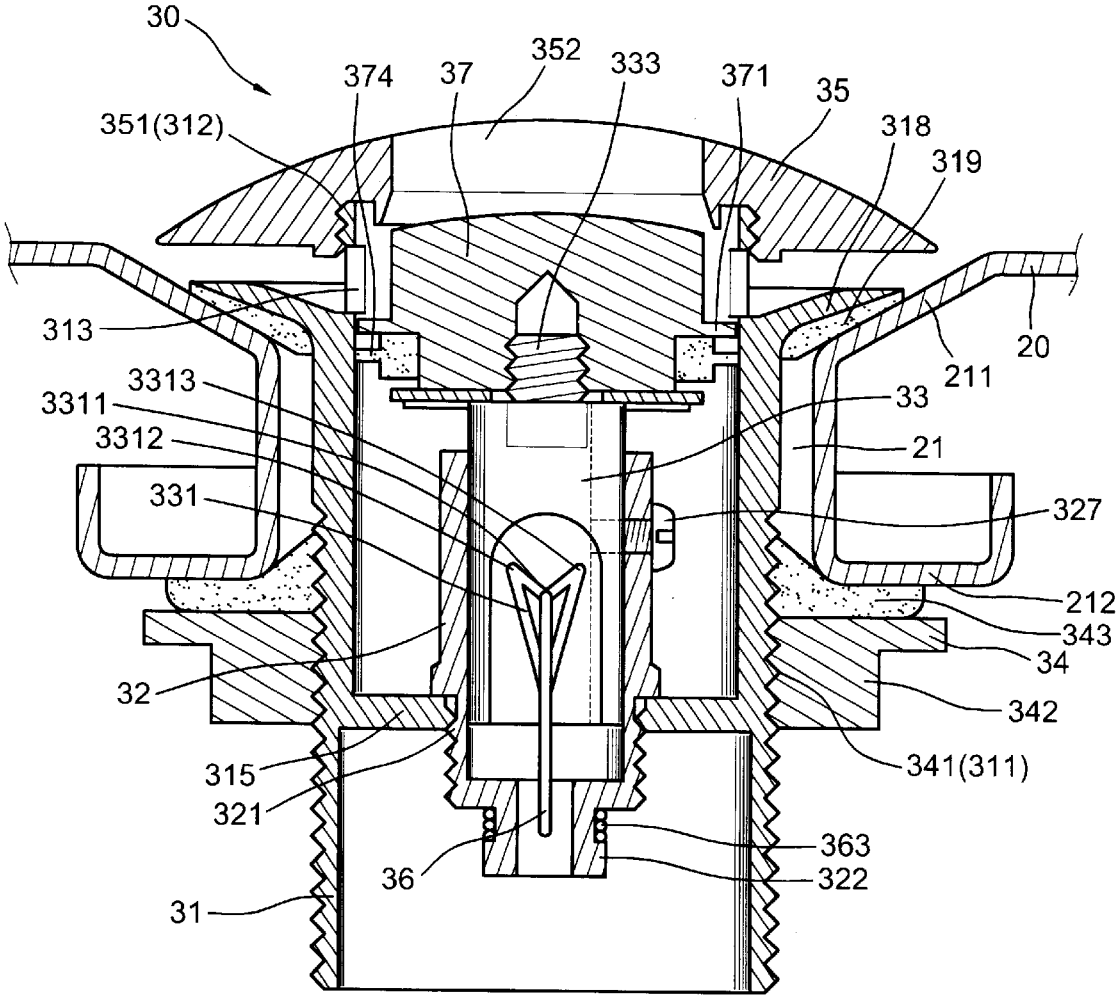
FIG. 6 is a sectional view while the water discharging is stopped.
Figure 7:
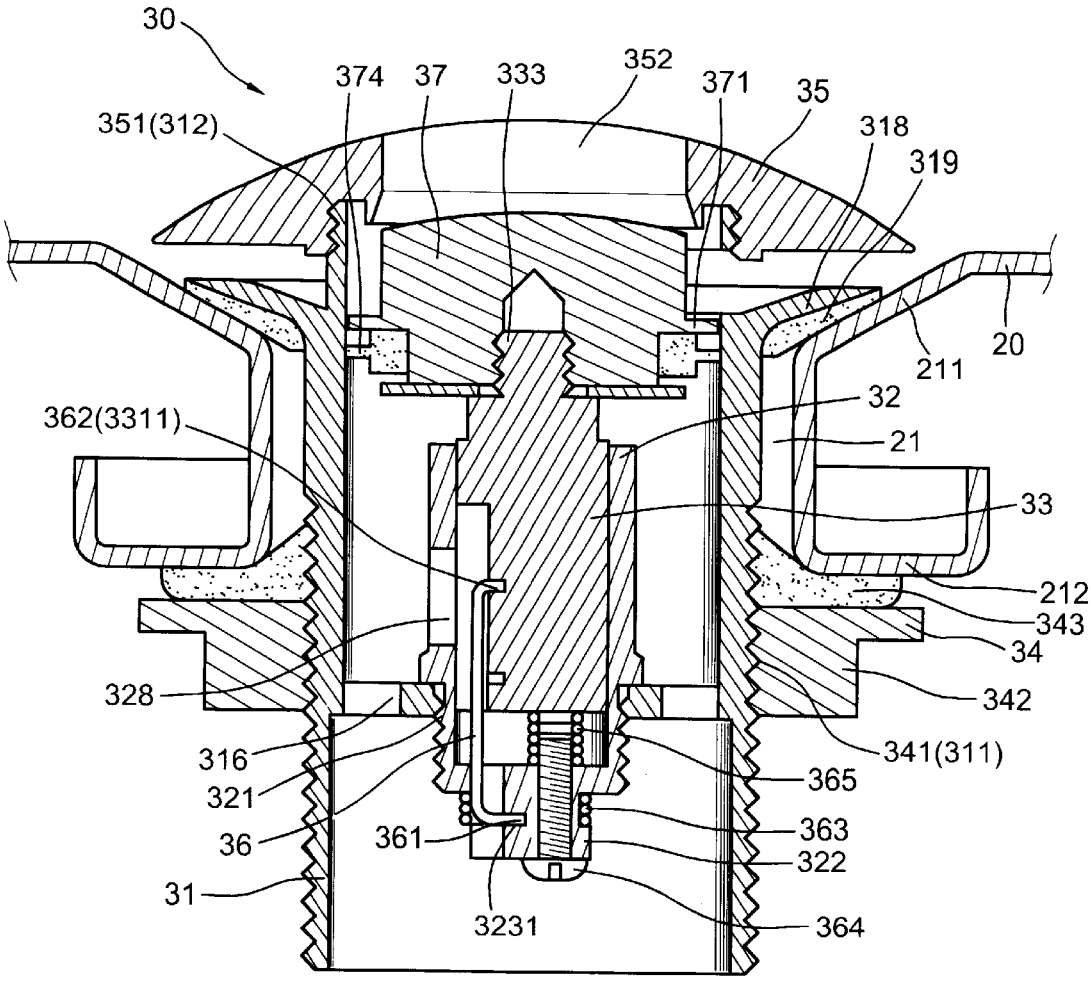
FIG. 7 is a sectional view from a lateral side of FIG. 6.

Referring to FIGS. 5, 6 and 7, when the button 37 is pressed downward a certain span, the slider 33 slides downward so that the second transverse end of the U-shaped positioning rod 36 slides upward along the double V-shaped slot 331 and temporarily stops at one of the two rest points 3312 or 3313 which are located above an upper stopping position 3311. When the button 37 is released, the slider 33 will slide a small span upward due to the resilience of the spring 365 so that the second transverse end 362 of the U-shaped positioning slot 36 engages with the upper stopping position 3311 of the double V-shaped slot 331. Therefore, water flow through the valve seat 31 is blocked by the flange 371 and sealing ring 374 to prevent water from discharging out of the valve seat 31 even with the water inlets 313 being open. Pressing on the button 37 again, the second transverse end 362 of the U-shaped positioning rod 36 will slide down via one of the rest points 3312 or 3313 and stops at the lower stopping position 3314. Therefore, the button 37 returns to its original position to permit water to be discharged through the arcuate water passages 316 and the valve seat 31.

Based on the above arrangement, the drain structure of the present invention provides a ready operation and meat outlook without requiring a lift rod or a stopper with a chain.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A drain structure for a sink comprising:

a tubular valve seat axially secured to a tube drain of a sink and having a first threaded outer periphery on a lower portion, a narrowed protrudent opening on top, a second threaded outer periphery abutting an upper rim of said opening, a plurality of water inlets spacedly formed in a periphery of said opening beneath the second threaded outer periphery, an annular flange extending outward from an outer periphery of the valve seat beneath the water inlets, said annular flange having an underside stopped against an upper rim of said tube drain with a first sealing ring engaged therebetween, and an annular shoulder in a center of said valve seat defining a pair of spaced apart arcuate water passages and a threaded central bore therein;

a first circular fastener fastened on the lower portion of the valve seat having its upper surface stopped against a lower rim of said tube drain with a second sealing ring engaged therebetween, said first circular fastener including a threaded central bore engaged with the first threaded outer periphery of the valve seat and a hexagon configuration on its underside adapted to facilitate the use of a wrench to fasten the fastener to the valve seat;

a tubular sleeve axially secured into the threaded central bore of the shoulder inside the valve seat and having a threaded outer periphery on a lower portion engaged with the threaded central bore of the shoulder, an annular flange extending outward from an outer periphery of said sleeve above said threaded outer periphery and having its underside stopped against an upper surface of said shoulder, a narrowed projection extending downward from a lower end of said sleeve having a lateral indentation communicating to the inside of the sleeve and including a transverse retaining hole therein, a longitudinal screw hole extending axially through said projection and being adapted to engage a screw which has a shank partially projected upward inside the sleeve for securing a lower end of a spring means thereon, an annular depression being formed around an upper periphery of the narrowed projection beneath the threaded outer periphery of said sleeve, a circular through hole extending through said sleeve directly above the annular flange of said sleeve and a transverse screw hole extending through said sleeve in an upper periphery of the sleeve at a position which is perpendicular to the position of said circular through hole, said transverse screw hole being adapted to engage a second screw which has a shank partially exposed inside of said sleeve;

a sliding means slidably disposed in said sleeve and having a longitudinal slot extending along a lateral side and adapted to slidably engage said shank of the second screw, a double V-shaped slot extending along another lateral side at a position which is perpendicular to the position of said longitudinal slot, and a threaded cylindrical protrusion projecting centrally upward from a top thereof;

a U-shaped positioning rod disposed in said sleeve and having a first transverse end engaged in the transverse retaining hole of said sleeve and secured by a packing means around the annular depression of the narrowed projection and a second transverse end slidably engaged in the double V-shaped slot of said sliding means;

a circular button secured to the top of said sliding means with a sealing ring and a washer engaged therebetween and having an annular flange extending outward from an outer periphery, and an circular projection projecting centrally downward from an underside thereof beneath said annular flange and having a threaded central bore centrally formed in a bottom of the circular projection and which engages the threaded cylindrical protrusion of said sliding means; and a second circular fastener having a threaded inner periphery engaged with the second threaded outer periphery of said valve seat to define a gap between the upper surface of the annular flange of said valve seat and the underside of said second circular fastener, and a circular central hole slidably engaging with circular button such that the annular flange of said circular button is engageable with an underside of said second circular fastener.

2. The drain structure as recited in claim 1 wherein said double V-shaped slot includes an upper stopping position, a lower stopping position and a pair of rest points disposed above said upper stopping position.

* * * * *